US008922305B2

(12) United States Patent
Oran

(10) Patent No.: US 8,922,305 B2
(45) Date of Patent: Dec. 30, 2014

(54) COMBLINE FILTER

(75) Inventor: Ekrem Oran, Nashua, NH (US)

(73) Assignee: Hittite Microwave Corporation, Chelmsford, MA (US)

( * ) Notice: Subject to any disclaimer, the term of this patent is extended or adjusted under 35 U.S.C. 154(b) by 771 days.

(21) Appl. No.: 13/068,500

(22) Filed: May 12, 2011

(65) Prior Publication Data

US 2011/0279176 A1 Nov. 17, 2011

Related U.S. Application Data

(60) Provisional application No. 61/395,396, filed on May 12, 2010.

(51) Int. Cl.
*H01P 1/203* (2006.01)
*H01P 7/08* (2006.01)

(52) U.S. Cl.
CPC ..... *H01P 1/20336* (2013.01); *H01P 1/2039* (2013.01); *H01P 7/082* (2013.01)
USPC ..... 333/205; 333/235

(58) Field of Classification Search
CPC .... H01P 1/20336; H01P 1/2039; H01P 7/082
USPC ..... 333/204, 205, 219, 235
See application file for complete search history.

(56) References Cited

U.S. PATENT DOCUMENTS 3,889,214 A 6/1975 Petitjean et al.
4,835,499 A 5/1989 Pickett
5,908,811 A * 6/1999 Das ..... 505/210
6,018,282 A * 1/2000 Tsuda ..... 333/205
6,437,965 B1 * 8/2002 Adkins et al. ..... 361/303
6,525,630 B1 2/2003 Zhu et al.
7,305,223 B2 * 12/2007 Liu et al. ..... 455/333
7,548,136 B1 6/2009 Shah
2008/0290465 A1 11/2008 de Vreede

OTHER PUBLICATIONS

David M. Alter, "Using PWM Output as a Digital-to-Analog Converter on a TMS320C240 DSP", Nov. 1998, Texas Instruments, p. 11.*

Kim et al., "Varactor-Tuned Combline Bandpass Filter Using Step-Impedance Microstrip Lines" IEEE Transactions on Microwave Theory and Techniques, vol. 52, No. 4, Apr. 1, 2004, pp. 1279-1283.

Chandler, S.R. et al., "Active Varactor Tunable Bandpass Filter", IEEE Microwave and Guided Wave Letters, vol. 3, No. 3, Mar. 1, 1993, pp. 70-71.

* cited by examiner

*Primary Examiner* — Robert Pascal
*Assistant Examiner* — Gerald Stevens
(74) *Attorney, Agent, or Firm* — Knobbe, Martens, Olson & Bear, LLP

(57) ABSTRACT

A microstrip combline bandpass filter includes an input port, an output port, and a plurality of resonators each including a microstrip line having a first end and a second end. One of the plurality of resonators is connected to the input port, and another of the plurality of resonators is connected to the output port. The filter also includes a plurality of pairs of series coupled varactors. The first end of each microstrip line is coupled to one of the pairs of varactors, and the second end of each microstrip line is coupled to ground.

23 Claims, 11 Drawing Sheets

COMBLINE FILTER

RELATED APPLICATIONS

This application hereby claims the benefit of and priority to U.S. Provisional Application Ser. No. 61/395,396, filed on May 12, 2010 under 35 U.S.C. §§119, 120, 363, 365, and 37 C.F.R. §1.55 and §1.78, which application is incorporated herein by reference.

FIELD OF THE INVENTION

The subject invention relates to a combline filter.

BACKGROUND OF THE INVENTION

Some electronic circuits, such as Frequency doublers and sub-harmonic VCOs, may generate unwanted frequency harmonics at half integers of the fundamental frequency. These spurious outputs are called sub-harmonics of the fundamental frequency. These unwanted signals are usually filtered with fixed mechanical or electrical circuits and brought down to acceptable levels. Such filtering preferably passes the fundamental frequency (Freq) with slight loss and good return loss while suppressing frequencies at Freq/2 and 3*Freq/2 and higher. If the particular circuit of interest has an operating range that spans near an octave of frequencies, the required filter becomes complex and might need to be tunable. Furthermore, electrical systems that span an octave will generally have amplitude response that falls off with frequency. For such systems a tunable filter that not only rejects frequencies at sub-harmonics but also compensates for the amplitude roll-off is desirable.

U.S. Pat. No. 3,889,214 discloses a tunable stripline combline filter that utilizes discrete manufacturing processes. U.S. Pat. No. 4,835,499 discloses a microstrip combline discrete circuit having less biasing circuitry. These filters are large, expensive, limited in upper frequency range and their resonators would need additional tuning in order to match them to each other due to their inherent mismatch. Also these filters have limited linearity performance.

U.S. Pat. No. 6,525,630 discloses microstrip tunable filters deposited onto a substrate. The filters of the '630 patent, although promising low loss and high Q, are rather expensive, have repeatability challenges, require high operating control voltages and need high isolation on the control lines. The filters also need to employ a pseudo-combline approach, where the microstrip ends opposite of the varactor cannot be grounded, but rather have to be extended in length and left open for DC isolation reasons.

There are applications in which it is desirable to have a bandpass filter which is more selective than the filters described above, and which may also have a tunable response that can reject other interfering signals close to the wanted signal. Examples of such applications are up-conversion mixers where variable LO frequencies may be used and wide band receiver front-ends having interfering frequencies.

BRIEF SUMMARY OF THE INVENTION

This invention results from the realization that a microstrip combline bandpass filter having excellent suppression of sub-harmonic frequencies, a low return loss, and insertion loss having an amplitude equalization feature can be effected by a plurality of resonators each including a microstrip line, and a plurality of pairs of series coupled varactors, with a first end of each microstrip line coupled to one of the pairs of varactors, and a second end of each microstrip line coupled to ground.

In one embodiment, this invention features a microstrip combline bandpass filter including an input port, an output port, and a plurality of resonators each including a microstrip line having a first end and a second end. One of the plurality of resonators is connected to the input port, and another of the plurality of resonators is connected to the output port. The filter also includes a plurality of pairs of varactors, each pair serially coupled. The first end of each microstrip line is coupled to one of the pairs of varactors, and the second end of each microstrip line is coupled to ground.

In a preferred embodiment, the filter which includes pairs of varactors may each be coupled between the first end of the corresponding microstrip line and ground. The filter may include a plurality of resistances, in which the second end of each microstrip line is coupled to ground through one of the resistances to provide the filter with greater amplitude response slope as a function of frequency. The each pair of varactors may include two diodes coupled together in an anode to anode or cathode to cathode configuration. A tuning circuit may be coupled to a junction between each pair of varactors for adjusting the center frequency of the filter. The tuning circuit includes a tuning control terminal and a plurality of inductances and resistances, one of the inductances and one of the resistances each coupled in series between the tuning control terminal and a junction between each pair of varactors.

The filter may include at least one variable capacitor coupled between the input port and the output port for providing bandreject notch. The least one variable capacitor may include two varactors coupled in series between the input port and the output port. The least one variable capacitor may include two pairs of series coupled varactors coupled in series between the input port and the output port. The filter may include a bandreject notch control circuit coupled to a junction between each pair of varactors for adjusting the frequency of the bandreject notch.

The filter may be implemented on a Monolithic Microwave Integrated Circuit (MMIC) die. A low pass filter may be also implemented on the Monolithic Microwave Integrated Circuit (MMIC) die. The low pass filter may be tunable. The filter may be implemented on a planar monolithic substrate. The monolithic substrate may be selected from the group of GaAs or SiGe. The monolithic substrate may be mounted in a surface-mount package. Each varactor may include a p-n junction, a field effect transistor (FET) and uses a capacitance between a gate and a source of the FET, a ferroelectric based capacitor, and/or a MEMS-based capacitor.

In another embodiment, this invention features a microstrip combline bandpass filter, including: an input port; an output port; a plurality of resonators each including a microstrip line having a first and second ends, the second end coupled to ground through a corresponding resistance, one of the plurality of resonators connected to the input port, another of the plurality of resonators connected to the output port; and a plurality of pairs of electrically tunable varactors, the varactors of each pair serially coupled and coupled between the first end of a corresponding microstrip line and ground.

In a preferred embodiment, the filter may further including a tuning circuit coupled to a junction between each pair of varactors for adjusting the center frequency of the filter. The tuning circuit may include a tuning control terminal and a plurality of inductances and resistances, one of the inductances and one of the resistances each coupled in series between the tuning control terminal and a junction between each pair of varactors.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
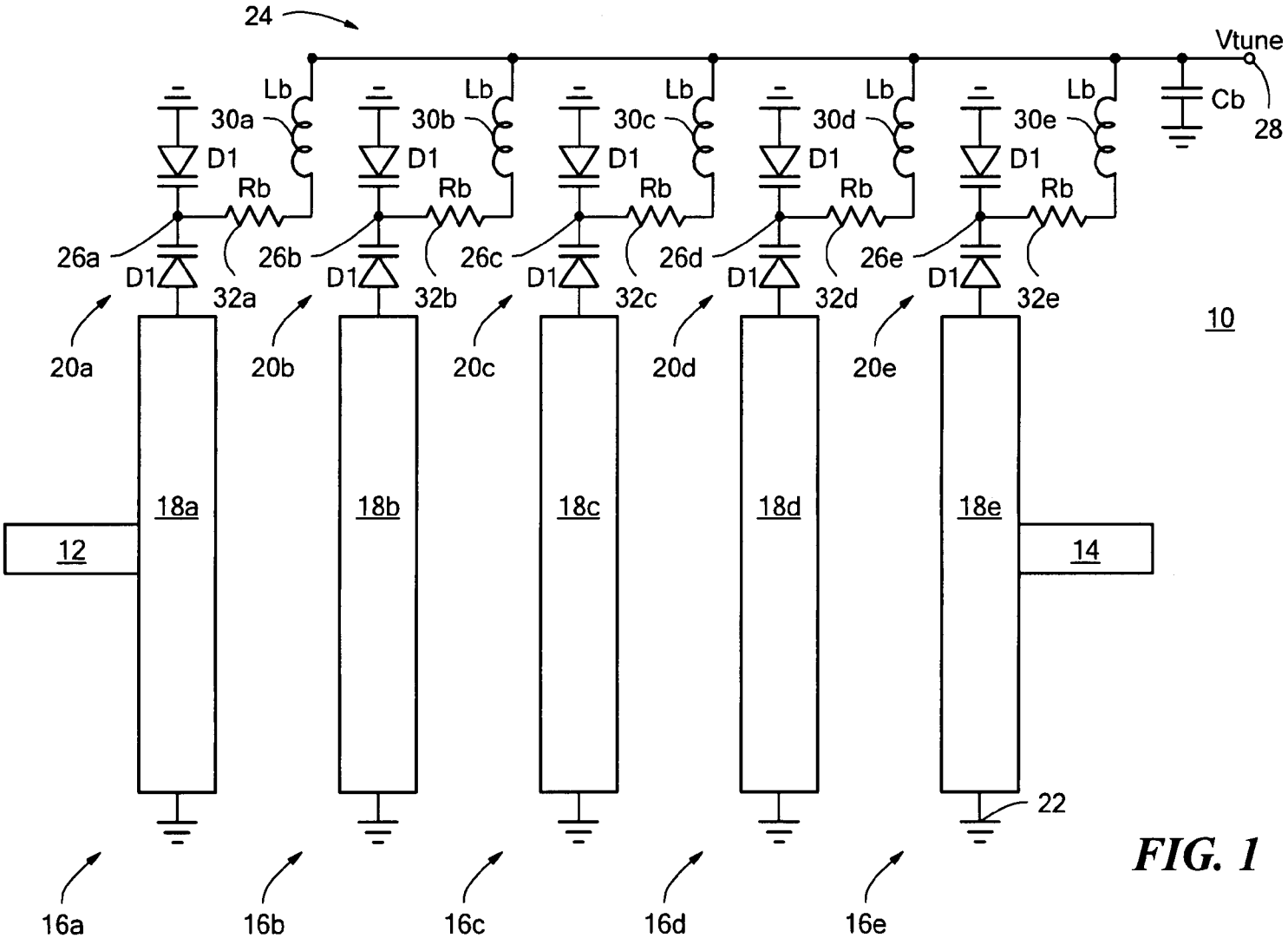
FIG. 1 is a circuit diagram of a combline filter in accordance with one embodiment of the subject invention.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the invention is not to be limited to that embodiment.

There is shown in FIG. 1 a preferred embodiment of a microstrip combline bandpass filter 10 in accordance with the subject invention. Combline bandpass filter 10 includes an input port 12, an output port 14, and a plurality of resonators 16*a-e* each including a microstrip line 18*a-e*. Resonator 16*a* is connected to input port 12, and resonator 16*e* is connected to output port 14. Combline bandpass filter 10 also includes a plurality of pairs of series coupled varactors 20*a-e*. A first end of each microstrip line 18*a-e* is respectively coupled to one of the pairs of varactors 20*a-e*, and the second end of each microstrip line 18*a-e* is coupled to ground 22.

A tuning circuit 24 is coupled to a corresponding junction 26*a-e* between each pair of varactors 20*a-e* for adjusting the center frequency of the filter. Tuning circuit 24 includes a tuning control terminal 28 and a plurality of inductances 30*a-e* and resistors 32*a-e*, with one of the inductances and one of the resistances each coupled in series between the tuning control terminal 28 and the corresponding junction 26*a-e* between each pair of varactors 20*a-e*.

By incorporating pairs of varactors 20*a-e* in filter 10*a*, the distortion created when large signal levels are applied is improved substantially by eliminating the non-symmetrical variation of capacitance under ac excitation around a given dc operating point. The pairs of varactors 20*a-e* may include back to back varactor diodes, configured either cathode to cathode or anode to anode, but other elements may be used for the varactors. For example, each of the varactors may include a pn junction. Each of the varactors may include a field effect transistor (FET) and use the capacitance between the gate and the source of the FET. Each variable capacitor may include a ferroelectric based capacitor. Also, each variable capacitor may include a MEMS-based capacitor.

Figure 2:
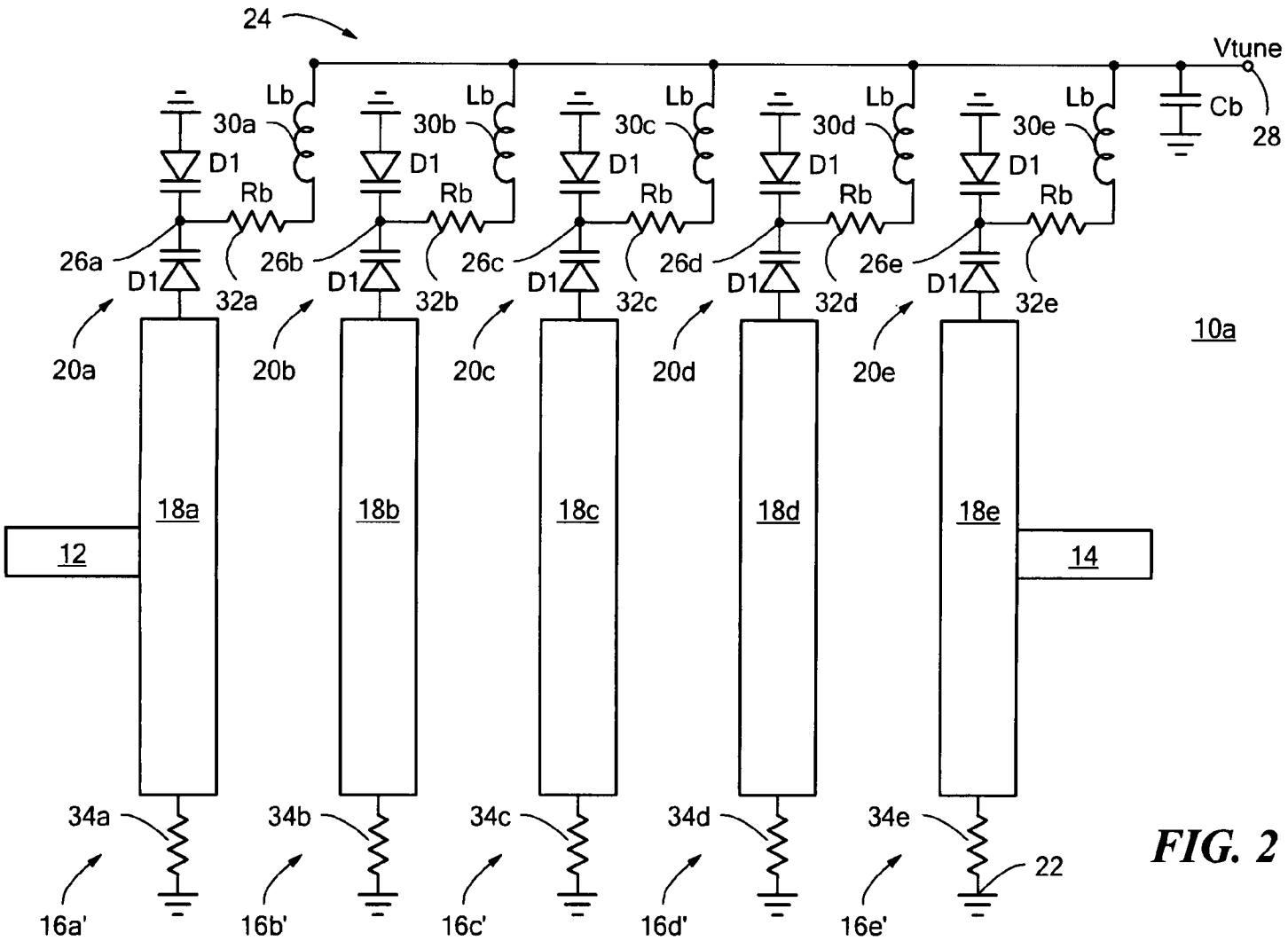
FIG. 2 is a circuit diagram of a combline filter in accordance with another embodiment of the subject invention.

In another embodiment, combline bandpass filter 10*a*, FIG. 2, includes resistors 34*a-e* respectively coupled between ground 22 and microstrip lines 18*a-e* of resonators 16*a*'-16*e*'. An end of each microstrip line 18*a-e* is coupled to ground 22 through one of the resistances to provide filter 10*a* with greater positive slope of passband amplitude response versus frequency.

Figure 3A:
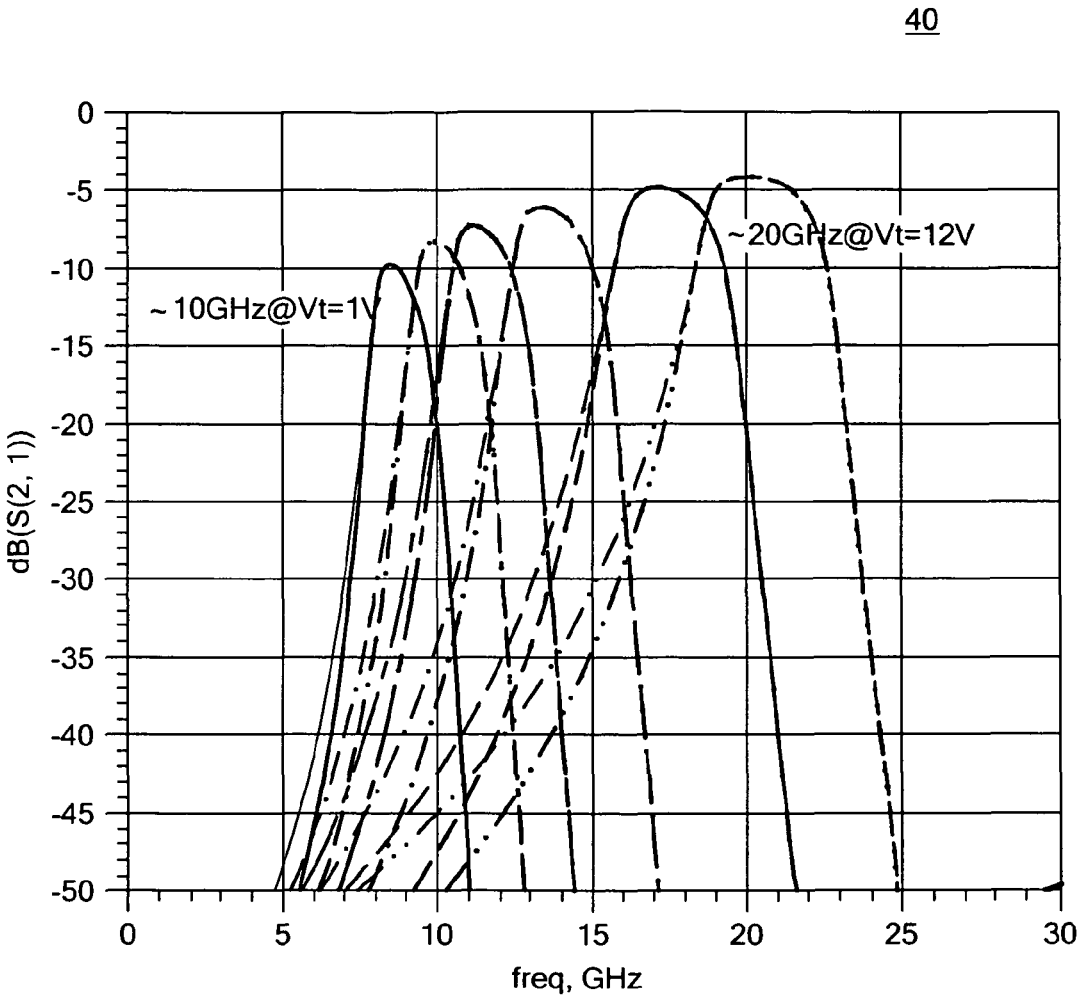
FIGS. 3A and 3B are plots showing the insertion loss performance and return loss performance, respectively, as a function of frequency at varying tune voltages.
Figure 3B:
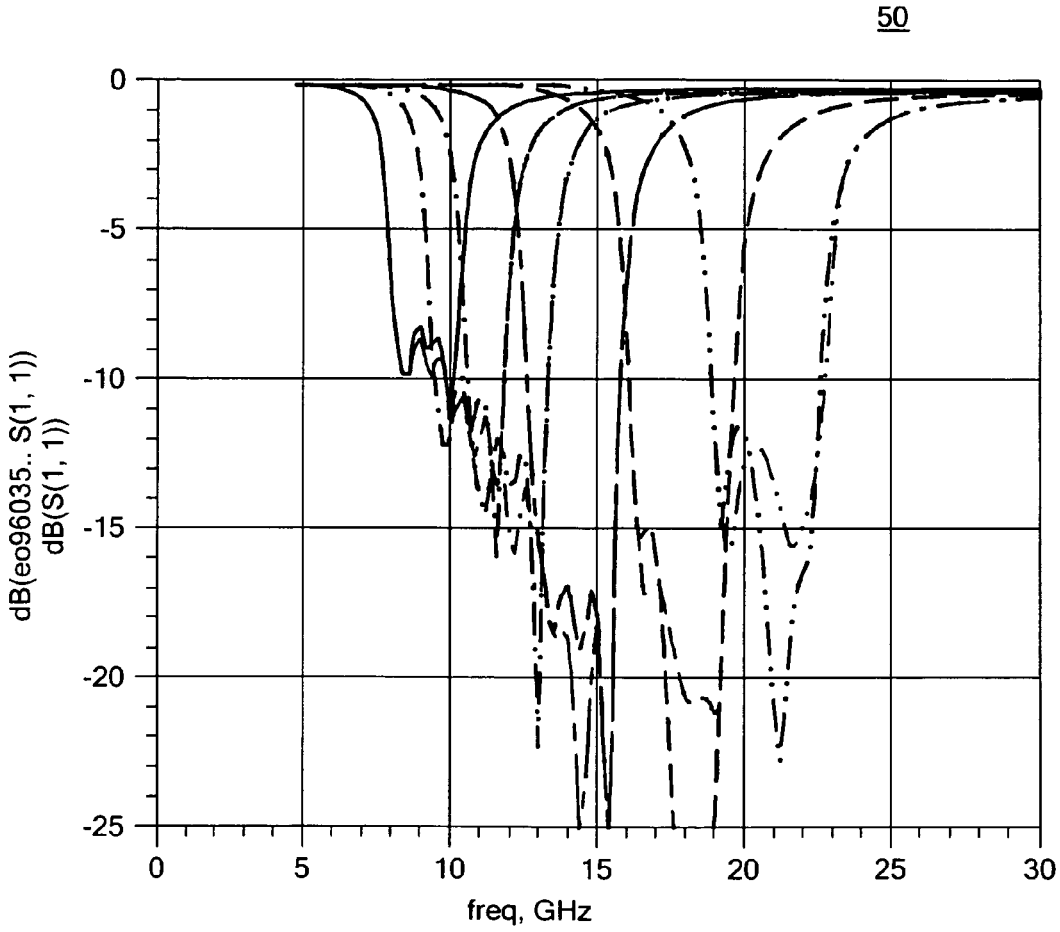
Figure 4A:
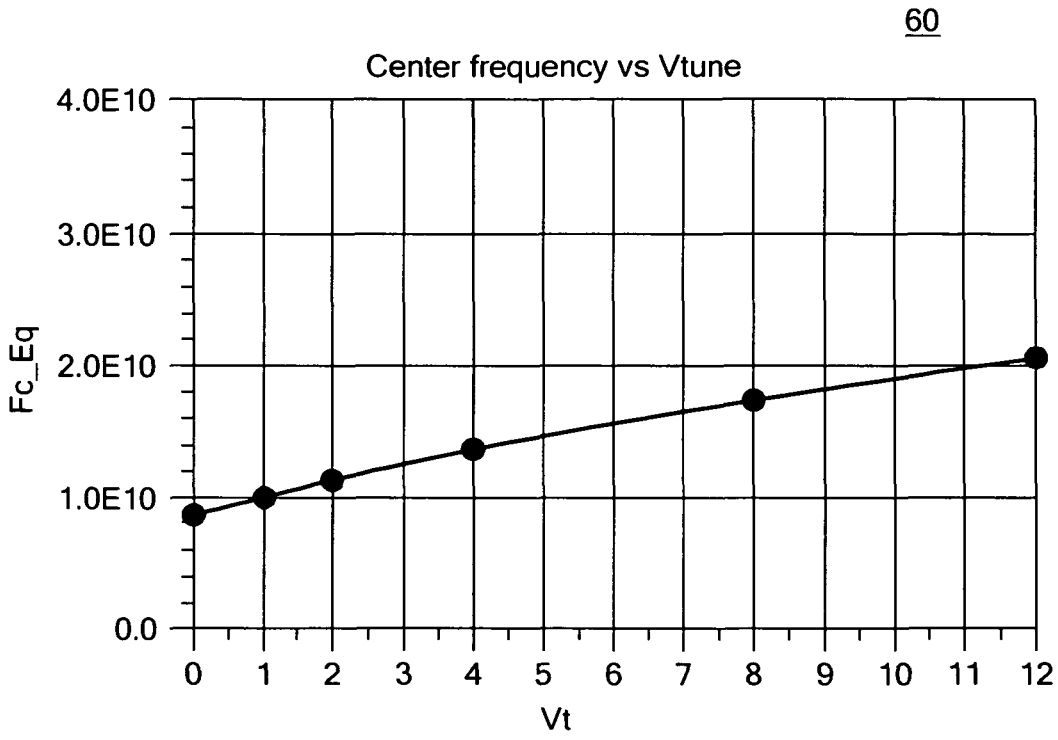
FIGS. 4A and 4B are graphs showing the center frequency and the 40 dB suppression points from the center frequency, respectively, as a function of tune voltage.
Figure 4B:
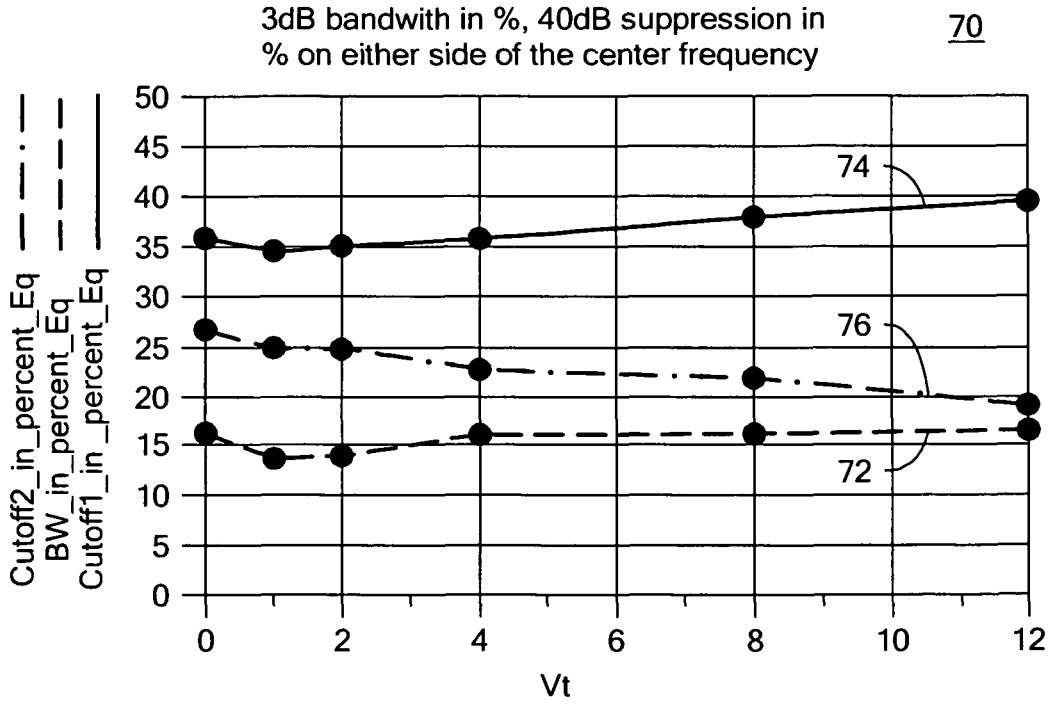

Plots 40 and 50, FIGS. 3A and 3B, respectively, show the insertion loss and return loss performance versus frequency at varying tuning voltages. Plot 40 shows that the peak values of the amplitude response curves increase as the filter is tuned to higher frequencies. Plot 60, FIG. 4A, shows the center frequency versus the tuning voltage. Plot 70, FIG. 4B, shows the 3 dB bandwidth 72 and the 40 dB suppression points 74 and 76 in percentage on either side of the center frequency versus the tuning voltage.

Figure 5:
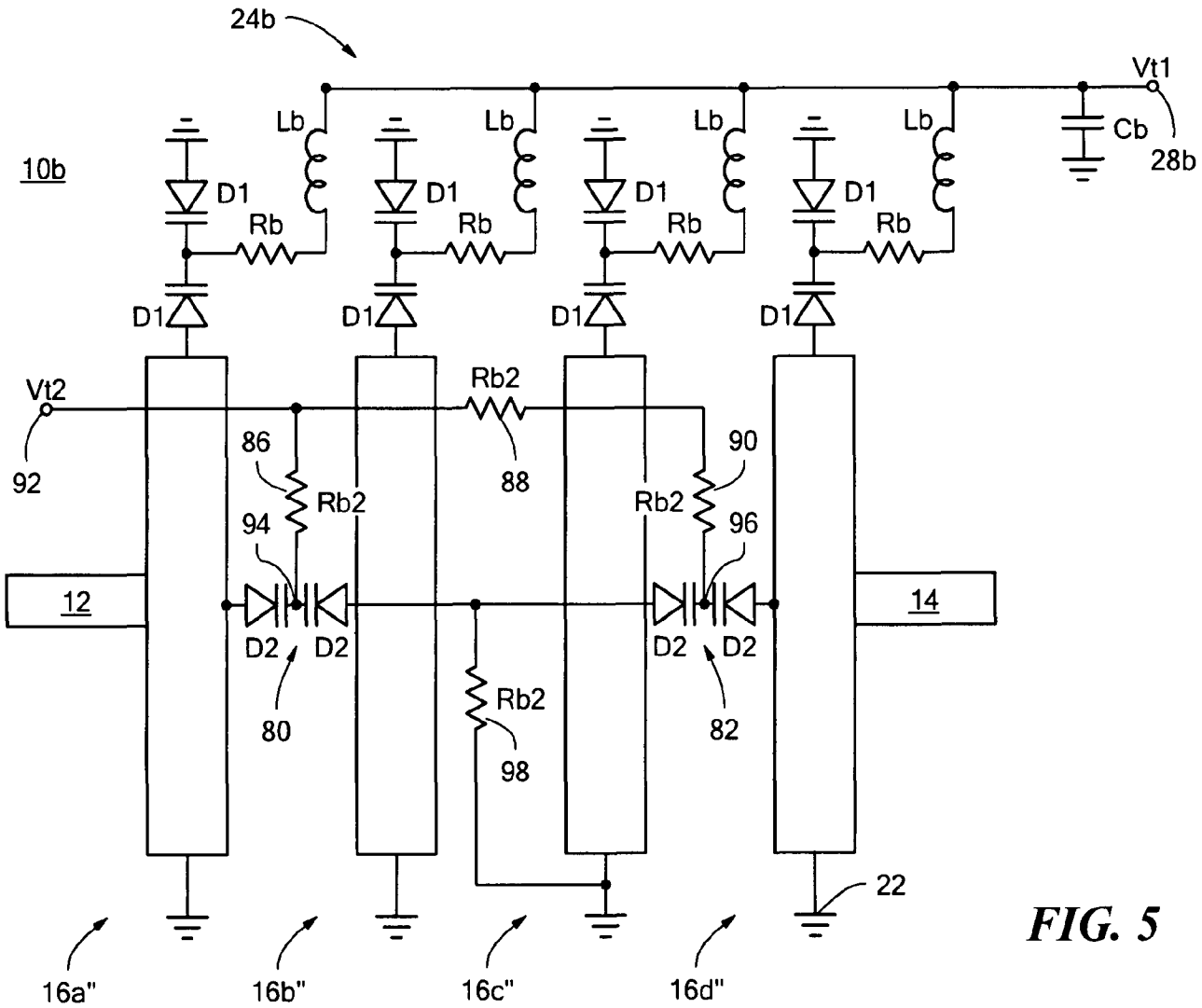
FIG. 5 is a circuit diagram of a combline filter in accordance with yet another embodiment of the subject invention.

To obtain an asymmetrical response, in another embodiment combline bandpass filter 10*b*, FIG. 5, includes at least one variable capacitor coupled directly between input port 12 and output port 14 for providing a bandreject notch. In this example, the variable capacitor includes two pairs of series coupled varactors 80 and 82 coupled in series between input port 12 and output port 14. A bandreject notch control circuit 84 includes resistors 86, 88 and 90 coupled between a bandreject notch control tuning port 92 and junctions 94 and 96 of varactors pairs 80 and 82 for adjusting the frequency of the bandreject notch. Resistor 98 is coupled between varactors pairs 80 and 82 and ground 22.

The configuration of combline bandpass filter 10*b* achieves a notch response and reduces complexity in comparison to prior filters that use additional elements to create non-adjacent resonator coupling. Also, the circuit of filter 10*b* is more compact and easier to layout since it includes four resonators 16*a*"-16*d*". Asymmetrical response is obtained by using varactors, such as the pairs of varactors 80 and 82, to couple some of the energy from the input and output and to channelize this energy through a microstrip/stripline that can be on a different layer than the main resonator lines or on the same plane but to the side. Varactors may be placed in a back to back configuration for increased linearity, and may include diode varactors or include different elements as described above.

Figure 6:
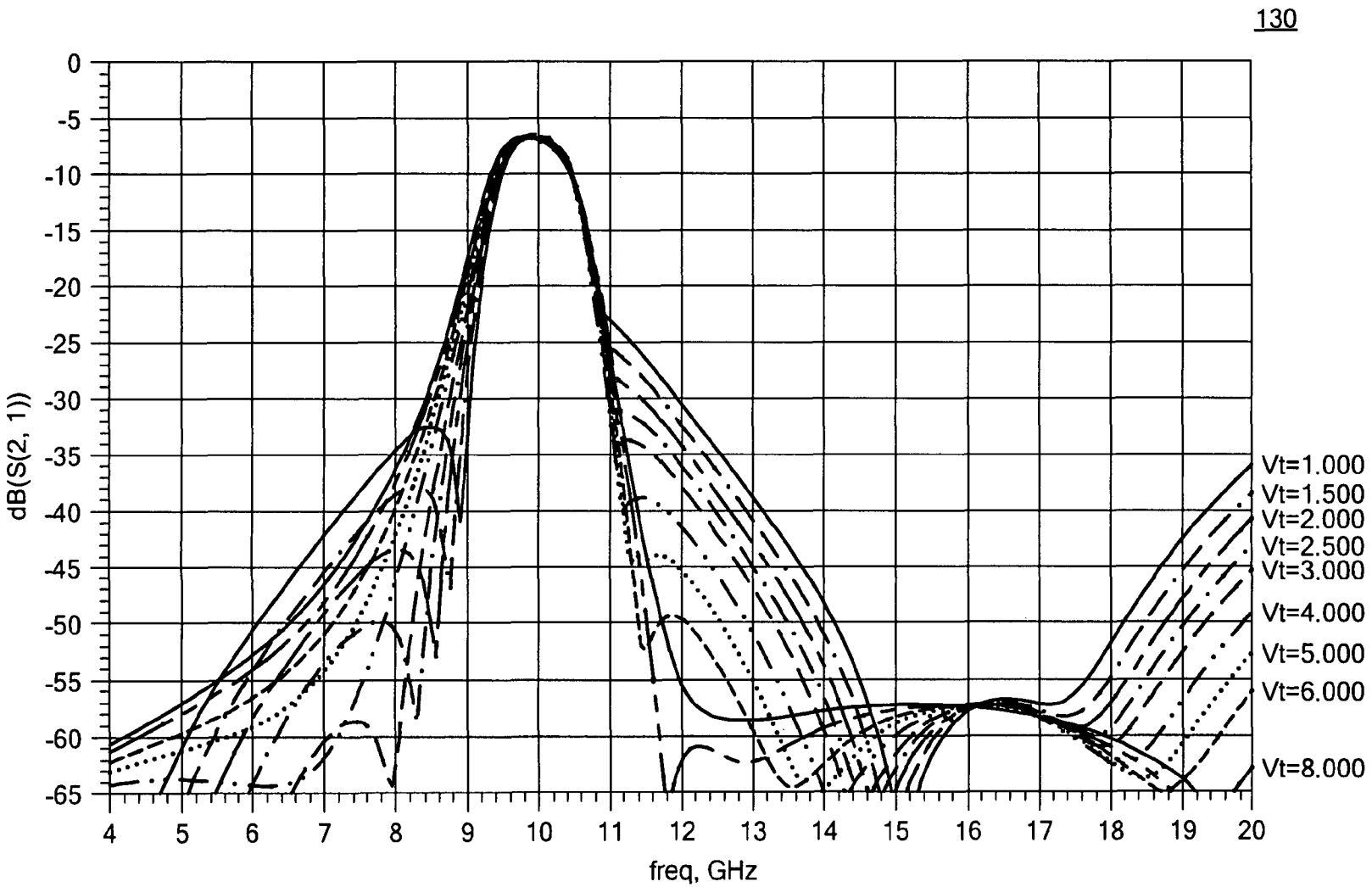
FIG. 6 is a plot showing the asymmetry of the filter response versus frequency with a constant center frequency tuning voltage and a varying coupling varactor tuning voltage.

Plot 100, FIG. 6, shows how the asymmetry of bandpass filter 10*b* changes while holding the center frequency tuning voltage constant and varying the coupling varactor tuning voltage only.

Figure 7:
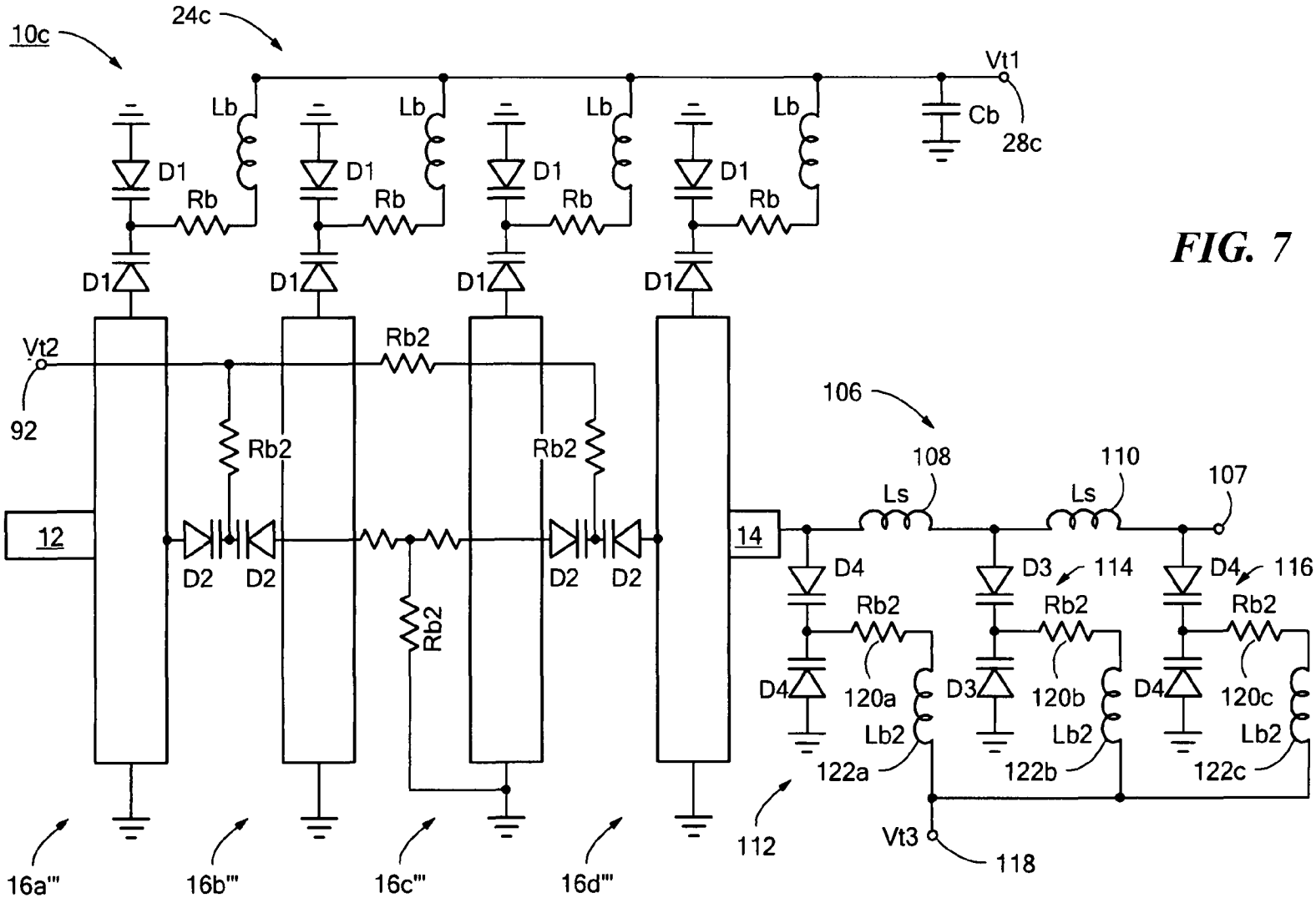
FIG. 7 is a circuit diagram of a combline filter in accordance with still yet another embodiment of the subject invention.

To increase the rejection of higher frequencies, combline bandpass filter 10*c*, FIG. 7, includes series resistors 102 and 104 on the coupling path. Combline bandpass filter 10*c* also includes a tunable lowpass filter 106 for additional suppression of higher frequencies. Lowpass filter 106 may include for example, two inductors 108 and 110 serially coupled between output port 14 and output 107. Serially coupled pairs of tunable varactors 112, 114 and 116 are coupled between two inductors 108 and 110 and ground. Varactors 112, 114 and 116 may be coupled to a lowpass filter tuning port 118 through resistors 120*a-c* and inductors 122*a-c*. Tuning ports 28*c* and 108 may be tied together or remain separate. Tuning ports 28*c*, 92 and 108 may also be tied together. Bandpass filter 10*c* may be implemented on a common Monolithic Microwave Integrated Circuit (MMIC) die together with tunable lowpass filter.

Figure 8:
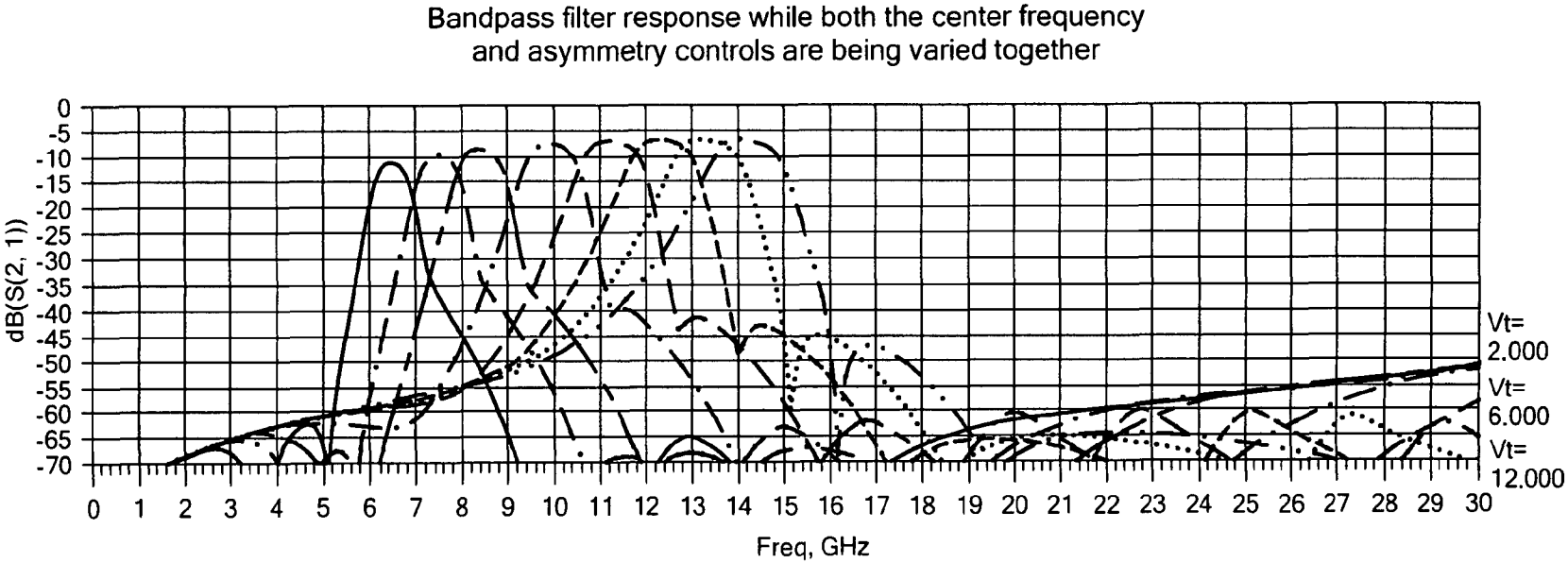
FIG. 8 is a plot showing the bandpass filter response versus frequency while the center frequency and asymmetry controls and the low pass filter control voltage are varied.

Plot 130, FIG. 8, shows the bandpass filter response while both the center frequency and asymmetry controls as well as the low pass filter control voltage are being varied together.

Figure 9:
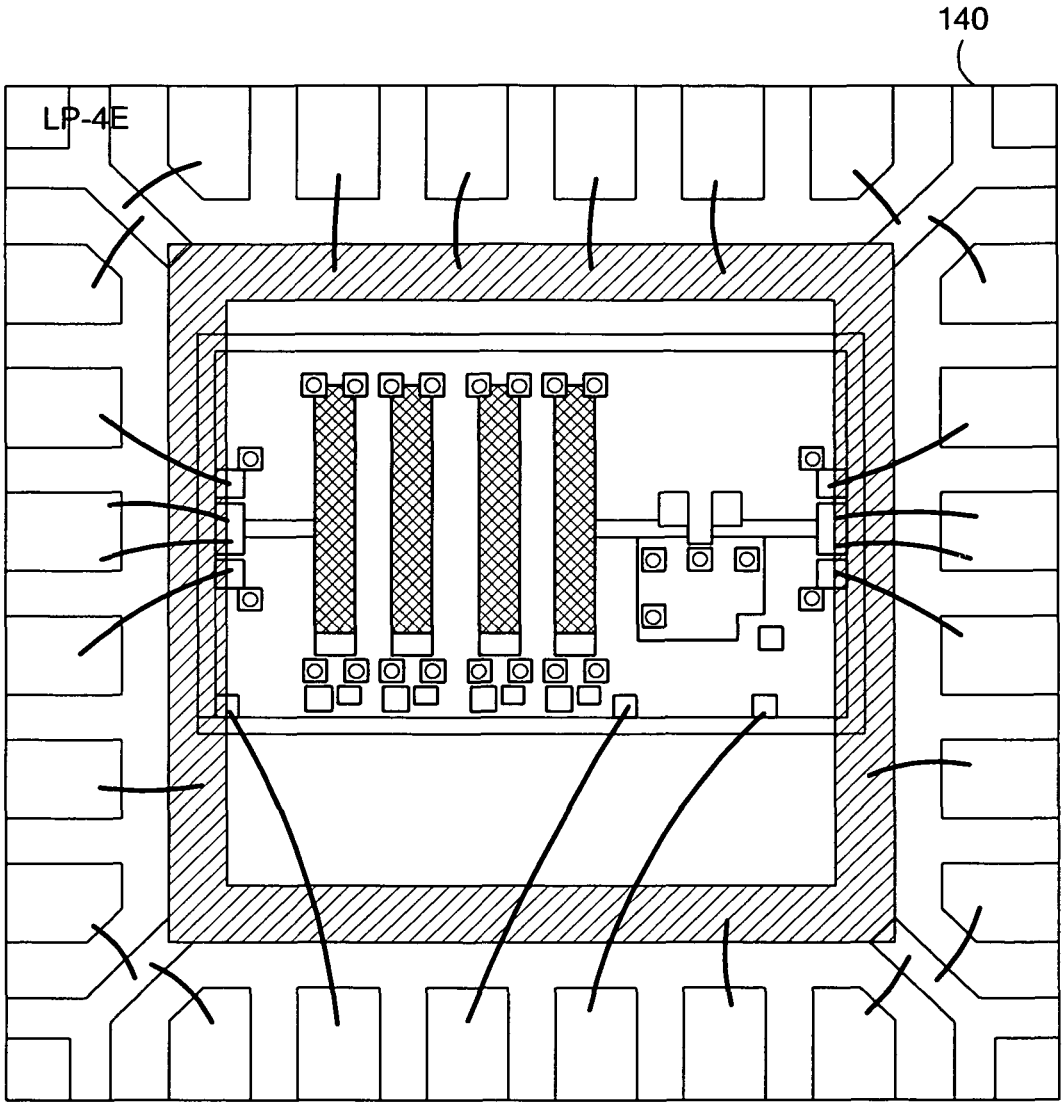
FIG. 9 is a bonding diagram of an exemplary die including one embodiment of the subject invention in a surface mount package.

The layout 140, FIG. 9, of the MMIC die and the bonding diagram show how the MMIC die is assembled into a surface mount package which enables use of low-cost assembly technology.

Combline bandpass filters 10*a-d* may be constructed in stripline form with two dielectrics attached on top of each other, and backside vias connecting the two ground planes together for improved performance.

Coupling in and out can be tapped as in the preferred version or electrically coupled through parallel adjacent electrical lines.

Embodiments of combline bandpass filter 10*a-d* typically provide 40 dB suppression at sub-harmonic frequencies, better than 10 dB return loss, and insertion loss that has an amplitude equalization feature. The equalization effect is due to the low reactance value of resonators 16*a-e* (preferred for wide tuning bandwidth) and the relatively high resistive components in the circuit such as the resistance of the coupled microstrip lines and the resistance of the varactors. As the filter is tuned higher in frequency and the reactance of the resonators increases while the overall resistance of the components stays relatively constant or decreases, the insertion loss of the circuit improves and amplitude equalization is achieved.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

Other embodiments will occur to those skilled in the art and are within the following claims.

What is claimed is:

1. A microstrip combline bandpass filter, comprising:

an input port;

an output port;

a plurality of resonators each including a microstrip line having first and second ends, one of the plurality of resonators connected to the input port, another of the plurality of resonators connected to the output port;

a plurality of pairs of varactors, the varactors in each pair serially coupled, the first end of each microstrip line coupled to one of the pairs of varactors, the second end of each microstrip line coupled to ground; and a plurality of resistances, in which the second end of each microstrip line is coupled to ground through one of the resistances to provide the filter with greater amplitude response slope as a function of frequency.

2. The filter of claim 1 in which the pairs of varactors are each coupled between the first end of the corresponding microstrip line and ground.

3. The filter of claim 1 in which each pair of varactors includes two diodes coupled together in an anode to anode or cathode to cathode configuration.

4. The filter of claim 1, further including a tuning circuit coupled to a junction between each pair of varactors for adjusting the center frequency of the filter.

5. The filter of claim 4, in which the tuning circuit includes a tuning control terminal and a plurality of inductances and resistances, one of the inductances and one of the resistances each coupled in series between the tuning control terminal and the junction between each pair of varactors.

6. The filter of claim 1, further including at least one variable capacitor coupled between the input port and the output port for providing a bandreject notch.

7. The filter of claim 6, in which the at least one variable capacitor includes two varactors coupled in series between the input port and the output port.

8. The filter of claim 6, in which the at least one variable capacitor includes two pairs of series coupled varactors coupled in series between the input port and the output port.

9. The filter of claim 8, further including a bandreject notch control circuit coupled to a junction between each pair of varactors for adjusting the frequency of the bandreject notch.

10. The filter of claim 1 in which the input port, the output port, the plurality of resonators and the plurality of pairs of varactors are implemented on a semiconductor-based Monolithic Microwave Integrated Circuit (MMIC) die.

11. The filter of claim 10 in which a low pass filter is also implemented on the Monolithic Microwave Integrated Circuit (MMIC) die.

12. The filter of claim 11 in which the low pass filter is tunable.

13. The filter of claim 10 in which the semiconductor-based MMIC die includes a planar monolithic substrate.

14. The filter of claim 13 in which the monolithic substrate includes a material selected from the group of GaAs and SiGe.

15. The filter of claim 13 in which the monolithic substrate is mounted in a surface-mount package.

16. The filter of claim 1 in which each varactor includes a p-n junction.

17. The filter of claim 1 in which each varactor includes a field effect transistor (FET) and uses a capacitance between a gate and a source of the FET.

18. The filter of claim 1 in which each varactor includes a ferroelectric based capacitor.

19. The filter of claim 1 in which each varactor includes a MEMS-based capacitor.

20. A microstrip combline bandpass filter, comprising:

an input port;

an output port;

a plurality of resonators each including a microstrip line, each microstrip line having first and second ends, the second end coupled to ground through a corresponding resistance, one of the plurality of resonators connected to the input port, another of the plurality of resonators connected to the output port; and a plurality of pairs of electrically tunable varactors, the varactors of each pair serially coupled and coupled between the first end of a corresponding one of the microstrip lines and ground.

21. The filter of claim 20, further including a tuning circuit coupled to a junction between each pair of varactors for adjusting the center frequency of the filter.

22. The filter of claim 21, in which the tuning circuit includes a tuning control terminal and a plurality of inductances and resistances, one of the inductances and one of the resistances each coupled in series between the tuning control terminal and the junction between each pair of varactors.

23. A semiconductor device comprising:

a semiconductor-based Monolithic Microwave Integrated Circuit (MMIC) die;

a microstrip combline bandpass filter implemented on the MMIC die, the filter including:

an input port;

an output port;

a plurality of resonators each including a microstrip line, each microstrip line having first and second ends, one of the plurality of resonators connected to the input port, another of the plurality of resonators connected to the output port;

a plurality of pairs of varactors, the varactors in each pair serially coupled, the first end of each microstrip line coupled to one of the pairs of varactors, the second end of each microstrip line coupled to ground; and a plurality of resistances, in which the second end of each microstrip line is coupled to ground through one of the resistances to provide the filter with greater amplitude response slope as a function of frequency, wherein each varactor includes a p-n junction.

* * * * *

UNITED STATES PATENT AND TRADEMARK OFFICE

CERTIFICATE OF CORRECTION

PATENT NO. : 8,922,305 B2
APPLICATION NO. : 13/068500
DATED : December 30, 2014
INVENTOR(S) : Ekrem Oran It is certified that error appears in the above-identified patent and that said Letters Patent is hereby corrected as shown below:

In the Claims

In column 6 at line 65, in Claim 20, change “resistance,” to --resistor,--.

Signed and Sealed this
Fourth Day of August, 2015

Michelle K. Lee

Michelle K. Lee
*Director of the United States Patent and Trademark Office*